US011230881B2

(12) United States Patent
Chen et al.

(10) Patent No.: US 11,230,881 B2
(45) Date of Patent: Jan. 25, 2022

(54) BLOCK AND TACKLE WINDOW BLIND

(71) Applicant: NIEN MADE ENTERPRISE CO., LTD., Taichung (TW)

(72) Inventors: Lin Chen, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 633 days.

(21) Appl. No.: 16/142,682

(22) Filed: Sep. 26, 2018

(65) Prior Publication Data

US 2020/0095825 A1 Mar. 26, 2020

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC . E06B 9/262; E06B 9/32; E06B 9/322; E06B 2009/3222; E06B 9/30; E06B 9/307; E06B 9/264
See application file for complete search history.

(56) References Cited

U.S. PATENT DOCUMENTS 2,420,301 A * 5/1947 Cusumano ..... E06B 9/305 160/170
6,283,192 B1 * 9/2001 Toti ..... E06B 9/30 160/170
7,025,107 B2 * 4/2006 Ciuca ..... E06B 9/303 160/170
8,245,756 B2 * 8/2012 Cheng ..... E06B 9/322 160/170
9,309,716 B2 * 4/2016 Chen ..... E06B 9/324
9,879,476 B2 * 1/2018 Sung ..... E06B 9/327
2007/0125505 A1 * 6/2007 Liang ..... E06B 9/262 160/170
2007/0284060 A1 * 12/2007 Liang ..... E06B 9/32 160/170
2015/0136335 A1 * 5/2015 Chang ..... E06B 9/306 160/168.1 R
2016/0208549 A1 * 7/2016 Chen ..... E06B 9/322
(Continued)

FOREIGN PATENT DOCUMENTS

AU 2015213287 B2 9/2016

*Primary Examiner* — Daniel P Cahn
(74) *Attorney, Agent, or Firm* — Muncy, Geissler, Olds and Lowe, P.C.

(57) ABSTRACT

A window blind includes a headrail and a covering structure provided below the headrail. The covering structure includes multiple slats, which can be turned, lifted, and lowered. A driving module is immovably provided in the headrail and includes a power unit. A modulation assembly includes an adjustment member which is drivable to drive an adjustment cord assembly, turning the slats. A block and tackle system is provided in the headrail, and includes a movable member, which is drivable by the power unit to optionally reciprocate in a longitudinal direction of the headrail. A lifting cord assembly is connected to the block and tackle system, and extends out of the headrail to be fixedly connected to a bottom of the covering structure. When the movable member reciprocates in the longitudinal direction, the lifting cord assembly is driven to lift or lower the covering structure.

18 Claims, 15 Drawing Sheets

(56) References Cited

U.S. PATENT DOCUMENTS

| | | | | |
|---|---|---|---|---|
| 2016/0356081 | A1* | 12/2016 | Sung | E06B 9/306 |
| 2017/0067287 | A1* | 3/2017 | Chen | E06B 9/322 |
| 2017/0268290 | A1* | 9/2017 | Hsu | E06B 9/32 |

* cited by examiner

BLOCK AND TACKLE WINDOW BLIND

BACKGROUND OF THE INVENTION

1. Technical Field

The present invention relates generally to a window blind, and more particularly to a block and tackle window blind which has no exposed cord.

2. Description of Related Art

A conventional window covering has an exposed cord suspended out of the window covering for operation. The main drawback of having an exposed cord is that the cord can be reached by children or toddlers. Serious injuries or even deaths can occur when young kids play with such a cord. To avoid this hazard, window coverings currently available on the market usually have cordless designs, which could eliminate the chances that children or toddlers may reach an exposed cord. In this way, the safety of window coverings can be ensured, and related accidents can be prevented.

Generally, a cordless window blind includes a headrail, a covering structure, which includes a slat assembly and a bottom rail, and a driving unit, which is usually a spring box. Take the cordless window blind disclosed in Chinese patent application No. 97109645, titled "Spring Motor," as an example. Said patent application discloses a window blind unit, which includes a headrail, a bottom rail, and several slats. A driving apparatus is appropriately provided in the headrail, wherein the driving device includes a mainspring driving device and a control device. The control device includes two soft cords, each of which is wound around one of two cord rollers of the driving device, wherein the soft cords extend outward from the corresponding cord roller to the bottom rail, where the soft cords are fixedly connected to.

The mainspring driving device includes an output roller, an energy-storing roller, and two cord rollers which are provided on two sides of the output roller and the energy-storing roller, respectively. The mainspring driving device further includes a spring member, which operably connects the output roller and the energy-storing roller.

When the bottom rail is grabbed and pulled downward, two soft cords respectively drives the corresponding cord rollers to rotate, one clockwise and one counterclockwise. Two gears of the cord rollers, an idler gear (i.e., a gear of the energy-storing roller), and a gear of the output roller mesh with each other, so that the gears of the cord rollers can mesh with the gear of the output roller in a mutually drivable manner. As a result, when the bottom rail is moved downward, the output roller is driven to rotate counterclockwise, which winds the spring member around the output roller.

To pull up the bottom rail and the slats, there has to be an upward force applied to the bottom rail; at the same time, the recovery force of the spring member will rewind the spring member around the energy-storing roller again. Such rewinding drives the output roller to rotate clockwise, which also drives the gear of the output roller to rotate in the same direction. Therefore, in this gear system, the gears of the cord rollers can be rotated in a way that one of them is rotated clockwise and the other one is rotated counterclockwise. Whereby, the cords can be wound around the corresponding cord rollers again.

The above structure has at least one drawback. Since the soft cords used to raise or lower the slats are independently wound around the corresponding cord rollers on two sides, any inconsistent winding movements happened while reeling in the cords or any irregular overlapping of the cords happened while winding the cords would cause inconsistent retreated cord lengths, leading to an inclined bottom rail. If the bottom rail fails to maintain in a horizontal state, the window blind may not be operated smoothly. Furthermore, the overall looking of the window covering would be not beautiful, either.

Therefore, how to ensure the bottom rail of a cordless window blind can be pulled and pushed smoothly, and how to maintain the bottom rail in a horizontal state are problems need to be overcome.

BRIEF SUMMARY OF THE INVENTION

In view of the above, one aspect of the present invention is to provide a window blind, which could be operated smoothly, and the bottom rail thereof could be maintained in a horizontal state, whereby to solve the problem that the bottom rail may incline while the slat assembly is being raised or lowered.

The present invention provides a window blind, which includes a headrail, a covering structure, a driving module, a modulation assembly, a block and tackle system, and a lifting cord assembly. The covering structure is provided below the headrail, wherein the covering structure includes a plurality of slats, which are adapted to be turned around a longitudinal direction thereof, and are adapted to be expanded downward or gathered upward relative to the headrail. The driving module is provided in the headrail in a manner that the driving module is immovable relative to the headrail, wherein the driving module includes a power unit. The modulation assembly includes at least one adjustment member and at least one adjustment cord assembly which are correspondingly provided, wherein the at least one adjustment member is provided in the headrail. The at least one adjustment cord assembly is connected to the corresponding one of the at least one adjustment member with an end thereof, and has a segment suspended from the headrail to be passed through by the slats. The at least one adjustment member is adapted to be driven to rotate, whereby to drive the corresponding at least one adjustment cord assembly to operate, turning the slats. The block and tackle system is provided in the headrail, wherein the block and tackle system includes a movable member which is concurrently operable along with the driving module, so that the movable member is adapted to be driven by the power unit of the driving module to optionally reciprocate in a longitudinal direction of the headrail. The lifting cord assembly is connected to the block and tackle system with an end thereof, and extends out of the headrail, wherein another end thereof is fixedly connected to a bottom side of the covering structure. When the movable member reciprocates along the longitudinal direction of the headrail, the lifting cord assembly is driven to expand or gather the slats of the covering structure.

By using the block and tackle system, the lifting cord assembly would be pulled by the same lengths on both sides while the cords are being rolled up or released. As a result, when the slat assembly is gathered or extended, the bottom rail could be ensured to stay in a horizontal state. Furthermore, the smoothness of operating the window covering and the overall looking in aesthetical aspect would be also taken good care of.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
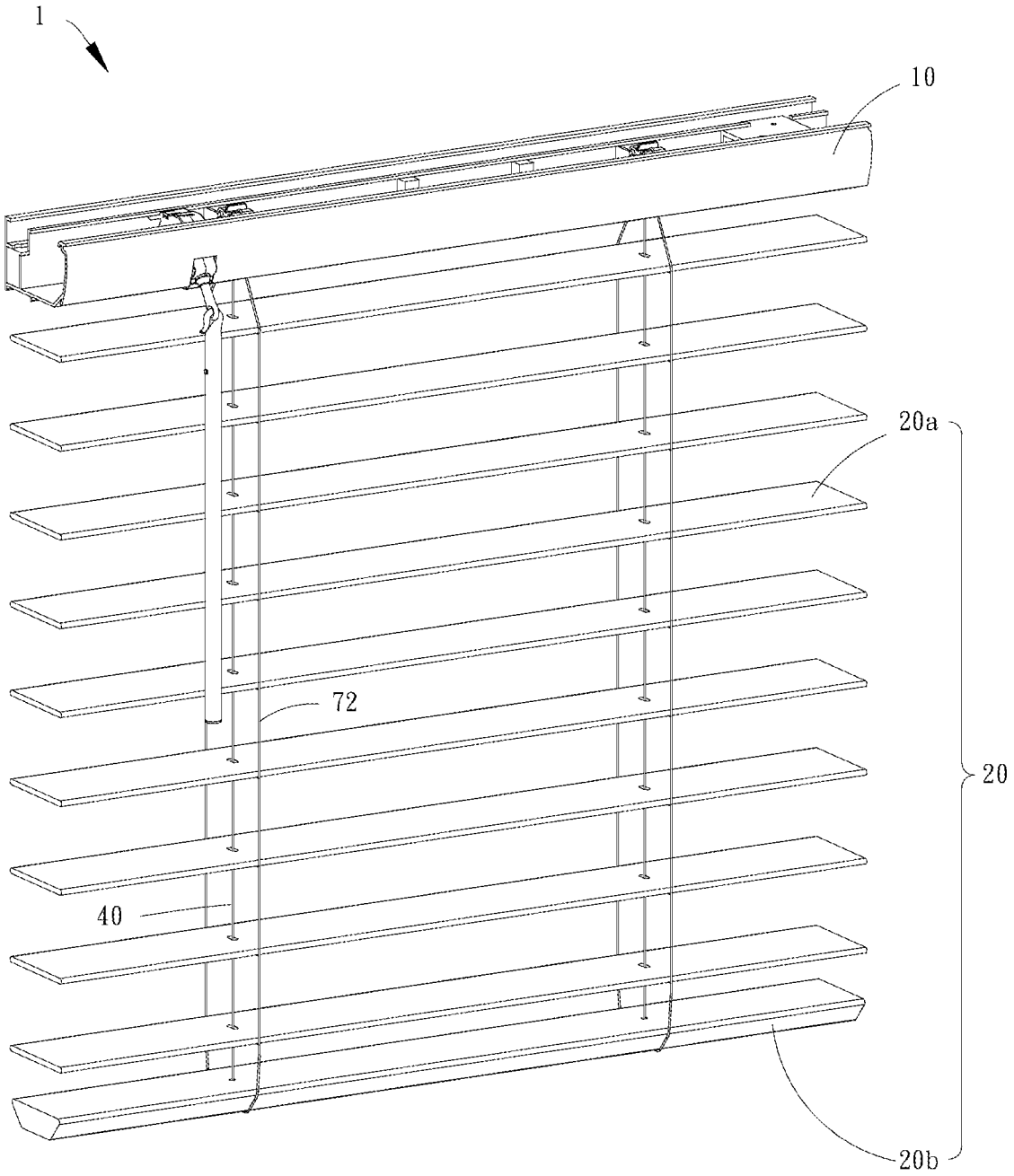
FIG. 1 is a perspective view of the window blind of a first embodiment of the present invention.
Figure 2:
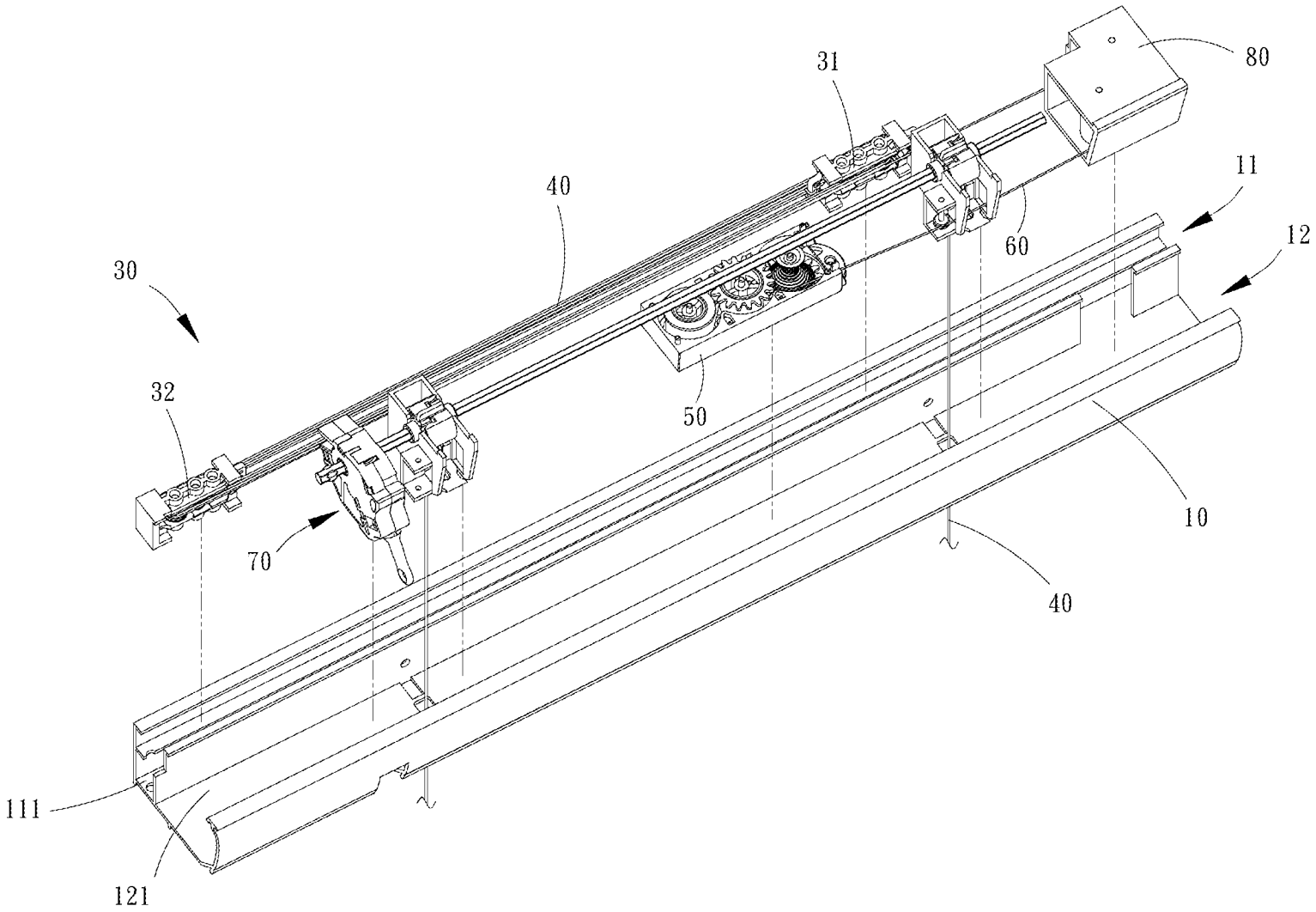
FIG. 2 is a perspective exploded view of the headrail of the window blind of the first embodiment, showing the internal structures and the arrangement of the lifting cord assembly.

A window blind 1 of a first embodiment of the present invention is shown in FIG. 1 to FIG. 8, which includes a headrail 10, a covering structure 20, a block and tackle system 30, a lifting cord assembly 40, a driving module 50, a transmission cord 60, and a modulation assembly 70. The covering structure 20 is provided under the headrail 10, including a plurality of slats 20*a* and a bottom rail 20*b*. The bottom rail 20*b* is located below the slat 20*a* which is farthest away from the headrail 10. However, understandably, the bottom rail 20*b* is not an indispensable component. In other embodiments, the bottommost slat of the covering structure 20 can be deemed an equivalent of the bottom rail. As shown in FIG. 2, the headrail 10 in the current embodiment has a first groove 11 and a second groove 12 which are adjacent to each other and both extend in a longitudinal direction of the headrail 10. The first groove 11 has a first bottom surface 111, and the second groove 12 has a second bottom surface 121. The first bottom surface 111 and the second bottom surface 121 are provided at a same height (i.e., provided in a coplanar manner), so that the first groove 11 and the second groove 12 are located side by side.

Figure 3:
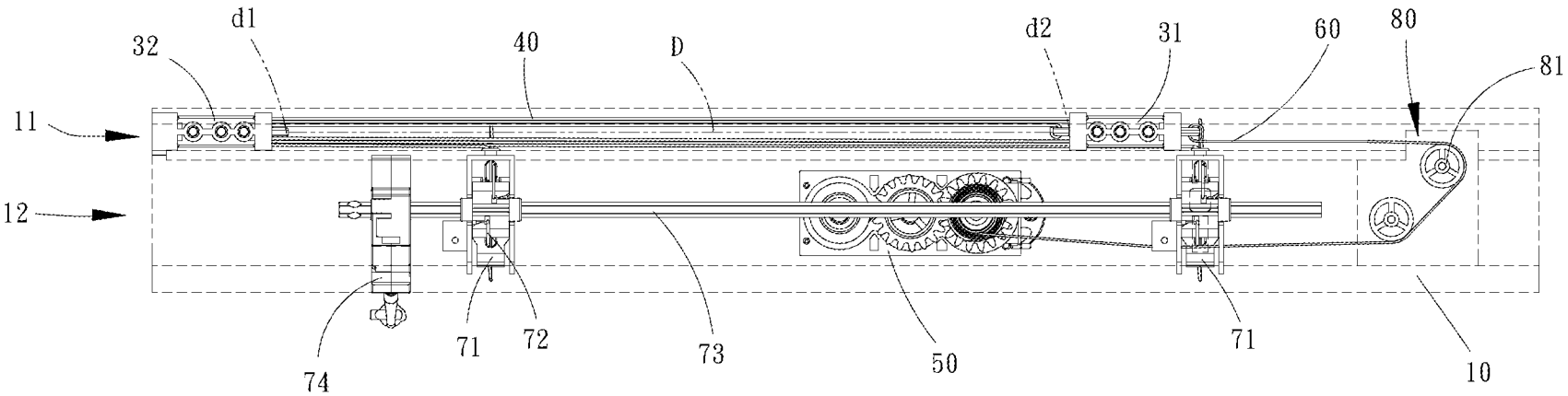
FIG. 3 is a top view of the headrail of the window blind of the first embodiment, showing the internal structures and the arrangement of the lifting cord assembly.
Figure 4:
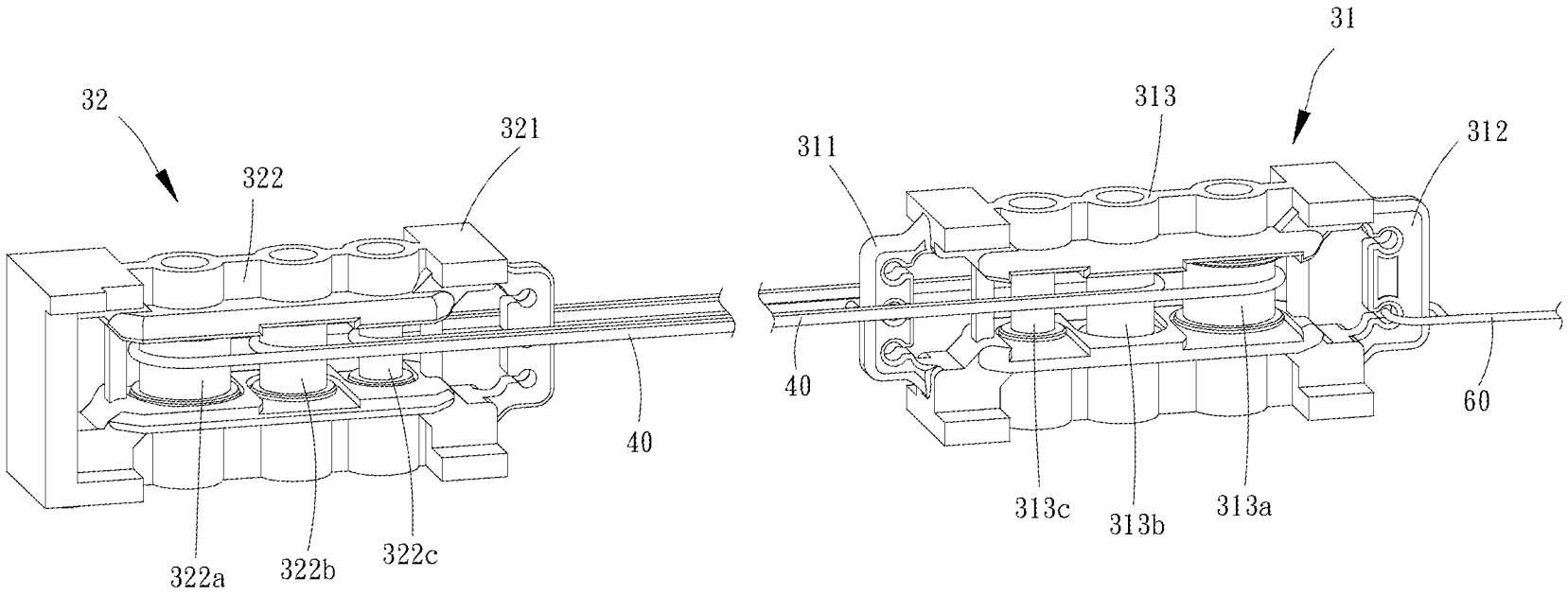
FIG. 4 is a perspective view of the block and tackle system shown in FIG. 2.
Figure 5:
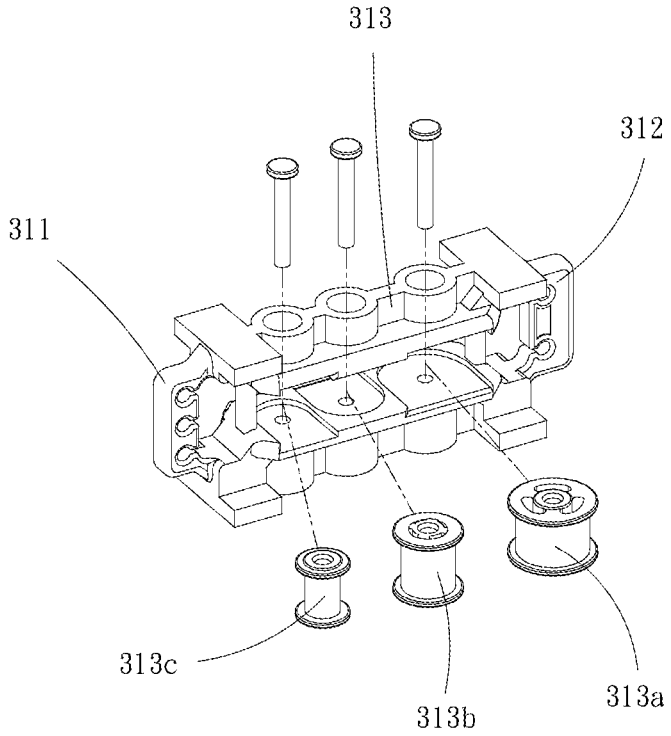
FIG. 5 is a perspective exploded view of the movable member shown in FIG. 4.
Figure 6:
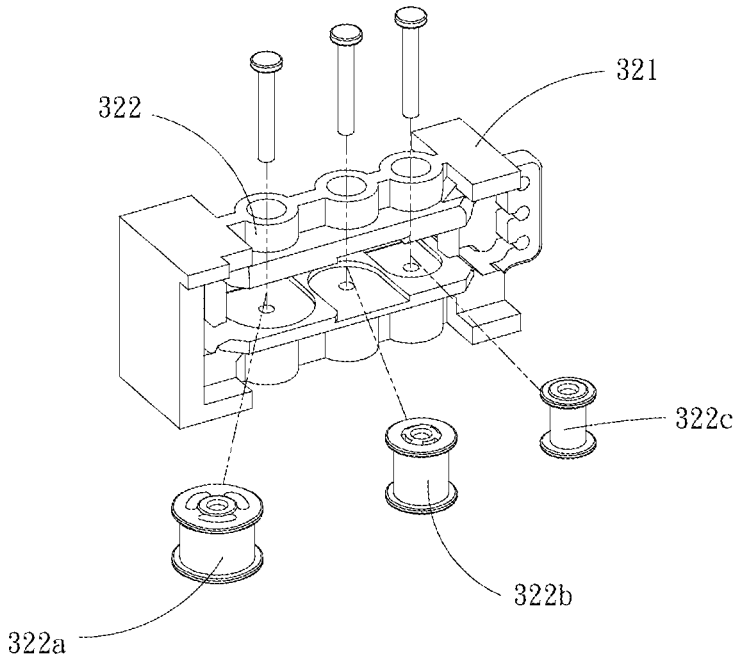
FIG. 6 is a perspective exploded view of the fixed member shown in FIG. 4.

The block and tackle system 30 is provided in the first groove 11 of the headrail 10, and includes a movable member 31 and a fixed member 32, wherein the fixed member 32 is provided in the first groove 11 in an immovable manner, while the movable member 31 is movably provided in the first groove 11 in a way that the movable member 31 is operable to move back and forth along a moving path D in the longitudinal direction of the headrail 10, whereby to approach or move away from the fixed member 32. Herein we are going to further explain the moving path D of the movable member 31. As shown in FIG. 3, the moving path D of the movable member 31 is the path that the movable member 31 passes when the movable member 31 reciprocates (i.e., moves toward or away from the fixed member 32) in the longitudinal direction of the headrail 10, and said moving path D has two endpoints d1 and d2, one of which is a moving endpoint d1 close to the fixed member 32, and the other one is a moving endpoint d2 away from the fixed member 32. In other words, the moving path D is between the moving endpoint d1 and the moving endpoint d2. The moving path D has two extension directions, including a first extension direction, which is defined by extending the moving path D toward the fixed member 32 from the moving endpoint d1 close to the fixed member 32, and a second extension direction, which is defined by extending the moving path D from the moving endpoint d2 in a direction opposite to the fixed member 32. Furthermore, the structures of the movable member 31 and the fixed member 32 are concretely shown in FIG. 4 to FIG. 6. Specifically speaking, the movable member 31 includes a first end portion 311, a second end portion 312, and a cord-winding portion 313 located between the first end portion 311 and the second end portion 312, wherein the cord-winding portion 313 is further sequentially provided with a first roller 313*a*, a second roller 313*b*, and a third roller 313*c*. A diameter of the first roller 313*a* is greater than a diameter of the second roller 313*b*, and the diameter of the second roller 313*b* is greater than a diameter of the third roller 313*c*. The fixed member 32 includes a connecting base 321 and a cord-winding base 322, wherein the cord-winding base 322 is further sequentially provided with a first rotator 322*a*, a second rotator 322*b*, and a third rotator 322*c*. A diameter of the first rotator 322*a* is larger than a diameter of the second rotator 322*b*, and the diameter of the second rotator 322*b* is larger than a diameter of the third rotator 322*c*. Furthermore, the rotators 322*a*, 322*b*, 322*c* of the cord-winding base 322 and the rollers 313*a*, 313*b*, 313*c* of the cord-winding portion 313 are arranged in a mirror-symmetry manner by their diameters.

The first end portion 311 of the movable member 31 faces the fixed member 32, and the second end portion 312 is located on an opposite side of the first end portion 311. A segment of the lifting cord assembly 40 which is contained in the headrail 10 passes by the rollers of the movable member 31 and the rotators of the fixed member 32, and an end of the lifting cord assembly 40 is fixedly connected to the first end portion 311 of the movable member 31. However, this is not a limitation of the present invention. To meet various requirements for assembly or design, the end of the lifting cord assembly 40 in the headrail 10 could also be fixedly connected to the fixed member 32. The lifting cord assembly 40 passes through the movable member 31 and the fixed member 32, and extends out of the headrail 10. Another end of the lifting cord assembly 40 is fixedly connected to the bottom rail 20*b* of the covering structure 20. In the current embodiment, with the end fixedly connected to the first end portion 311 of the movable member 31, the lifting cord assembly 40 first passes by the first rotator 322*a* of the fixed member 32, and then passes by the first roller 313*a*, whereby to make a full turn (i.e., a single round). After that, the lifting cord assembly 40 sequentially passes by the second rotator 322*b*, the second roller 313*b*, and the third rotator 322*c*. In other words, the lifting cord assembly 40 makes two and a half turns in the headrail 10, and, as mentioned above, extends out of the headrail 10 downwardly, with another end thereof fixedly connected to the bottom rail 20*b*. Since the rollers and the rotators have different diameters, the lifting cord assembly 40 which passes thereby could extend in the same directions without interfering with itself. Understandably, the aforementioned sequence about how the lifting cord assembly 40 passes by the rotators and the rollers is not a limitation of the present invention. Specifically, after the end of the lifting cord assembly 40 is fixedly connected to one of the movable member 31 and the fixed member 32, whether it passes by the other one component or runs back and forth to pass by both of them, how many turns it takes, and any arrangements like these can be decided as required, taking the full length of the overall covering structure and the allowed moving path of the movable member into consideration. Preferably, the lifting cord assembly 40 passes through the block and tackle system 30 with 1.5 to 4 turns; in other words, a moving distance of the lifting cord assembly 40 outside the headrail 10 while lifting or lowering the covering structure 20 (i.e., a moving distance of the bottom rail 20*b*) is 3 to 8 times a moving distance of the movable member 31 inside the headrail 10. It is worth mentioning that, the longer the full length of the covering structure 20 is, the longer the cord length which has to be retrieved or released will be. Understandably, in such condition, the covering structure 20 will also be heavier. On the premise of not to change the moving path of the movable member 31, the lifting cord assembly 40 will need to pass through the block and tackle system 30 with more turns, whereby to deal with the cord length required to be raised or lowered. To make more turns, the lifting cord assembly 40 has to pass through more rotators and more rollers, and therefore would be provided with greater frictional resistance. As a result, when there is no external force applied to the covering structure 20, all forces applied to the lifting cord assembly 40, including the frictional resistance, the weight of the covering structure 20, and the pulling force provided by the driving module 50, would cancel each other out and come to equilibrium. Furthermore, if the covering structure 20 has a longer full length, it would also have a greater weight. Correspondingly, the driving module 50 would have to provide a greater pulling force, and the lifting cord assembly 40 would have greater frictional resistance generated thereupon, so that the covering structure 20 could stay at a required position.

Figure 7:
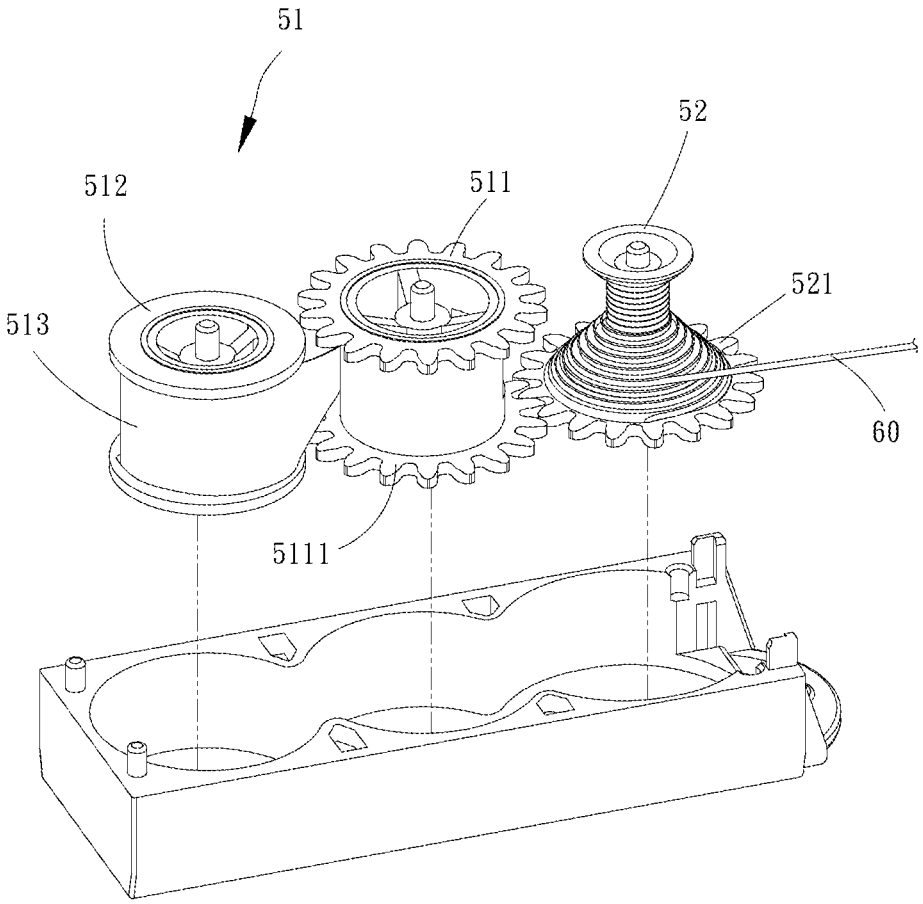
FIG. 7 is a perspective exploded view of the driving module of the present invention.

As shown in FIG. 2 and FIG. 3, the driving module 50 is immovably installed in the second groove 12 of the headrail 10. Furthermore, as shown in FIG. 7, the driving module 50 includes a power unit 51 and a reel 52, wherein the reel 52 and the power unit 51 are provided in a manner that they can be concurrently operated along with each other. In the current embodiment, the power unit 51 includes a driving wheel 511, a storage wheel 512, and a mainspring 513. The mainspring 513 connects the driving wheel 511 and the storage wheel 512. The reel 52 has a first gear disk 521 provided at a bottom end thereof, while the driving wheel 511 has a second gear disk 5111 at a bottom end thereof, wherein the first gear disk 521 of the reel 52 meshes with the second gear disk 5111 of the driving wheel 511, so that the reel 52 and the driving wheel 511 can be concurrently operated along with each other. An end of the mainspring 513 is located at the storage wheel 512, and another end thereof is fixedly connected to the driving wheel 511. The driving wheel 511 and the storage wheel 512 rotate in one direction when the covering structure 20 is being maneuvered to spread downward, and rotate in an opposite direction when the covering structure 20 is being maneuvered to gather upward. The mainspring 513 is wound around the driving wheel 511 or the storage wheel 512 in accordance with their rotating directions. In the current embodiment, a body of the reel 52 is partly cone-shaped, with an upper side narrower than a bottom side thereof. Roughly speaking, a diameter of the body gradually increases from the top down. Said reel 52 could be operated to be rotated clockwise or counterclockwise. The reel 52 has a spiral cord groove provided on a surface thereof, and has a first gear disk 521 provided near the bottom end which has a larger diameter. More specifically, an upper part of the body has a constant diameter, which equals the narrowest diameter of the cone-shaped part. In other words, when seen from side, the outline of the body would be like a reversely placed funnel. However, such shape is not a limitation of the present invention. In other embodiments, the body of the reel 52 could be simply cone-shaped without the aforesaid straight part which has a constant diameter, or, the body could also be cone-shaped but has a curved surface, or, a simple cylinder which has a constant diameter all the way down would also be feasible. In addition, the mainspring 513 could be a variable force spring or a constant force spring, depending on the conditions including the full length of the covering structure 20, the change in weight during operation, and the shape of the reel 52, etc.

The driving module 50 is connected to the block and tackle system 30 through the transmission cord 60, wherein an end of the transmission cord 60 is connected to the reel 52, where the transmission cord 60 is adapted to be wound around. The transmission cord 60 passes through the driving module 50, and another end of the transmission cord 60 is connected to the second end portion 312 of the movable member 31. When the movable member 31 is moved to approach the fixed member 32 along the moving path D, the transmission cord 60 is released from the reel 52; when the movable member 31 is moved in a direction away from the fixed member 32 along the moving path D, the transmission cord 60 is gradually wound around the reel 52. With such design, the block and tackle system 30 and the driving module 50 could operate synchronously.

Figure 8:
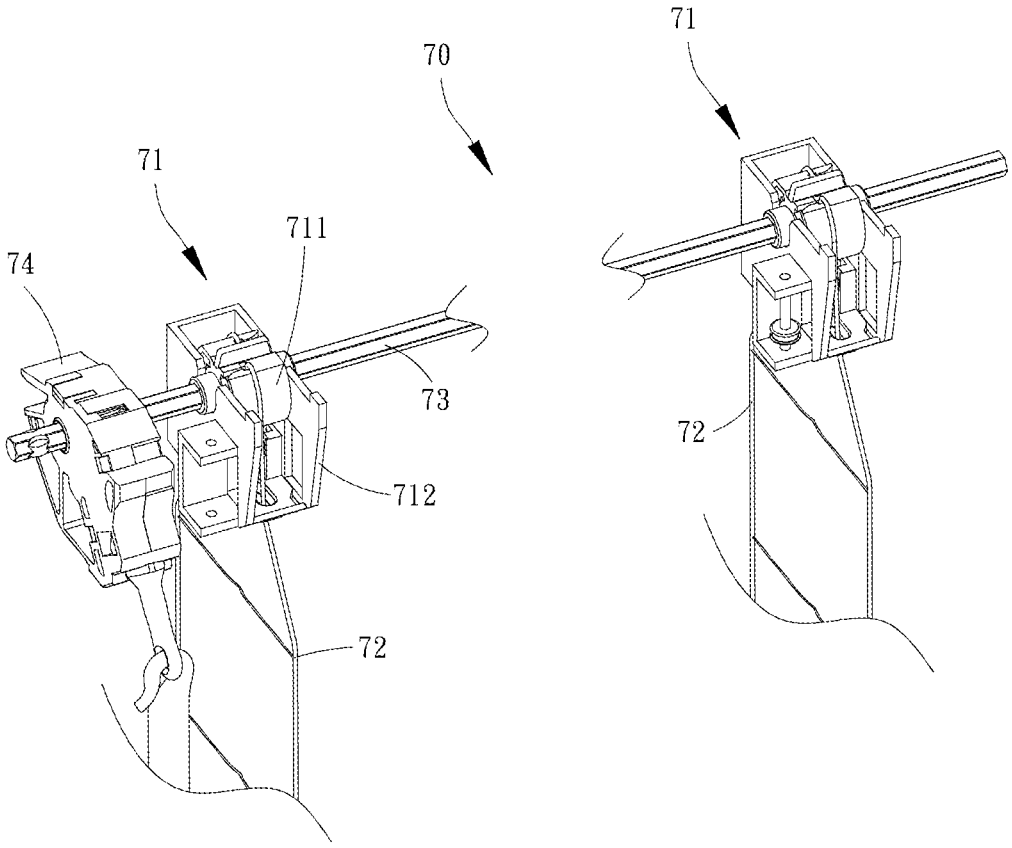
FIG. 8 is a perspective view of the modulation assembly of the present invention.

As shown in FIG. 2, FIG. 3, and FIG. 8, the modulation assembly 70 is also immovably provided in the second groove 12 of the headrail 10, wherein the modulation assembly includes two adjustment members 71, two adjustment cord assemblies 72, a transmission rod 73, and a modulation unit 74. The two adjustment members 71 are provided in a spaced-out manner, with the driving module 50 provided therebetween. The fixed member 32 is not located between the adjustment members 71. Each of the adjustment cord assemblies 72 is respectively connected to the corresponding adjustment member 71. The transmission rod 73 passes through the adjustment members 71, and an end of the transmission rod 73 is connected to the modulation unit 74 to be driven by the modulation unit 74. The adjustment member 71 includes a drum 711 and a drum holder 712, wherein the drum holder 712 is fixedly provided in the second groove 12, and the drum 711 is rotatably provided on the drum holder 712. Furthermore, the transmission rod 73 passes through the drums 711. An end of each of the adjustment cord assemblies 72 is connected to the corresponding drum 711, respectively, whereby the adjustment cord assemblies 72 are hung below the headrail 10, to be passed through by the slats 20*a*. When an operational end of the modulation unit 74 exposed in front of the headrail 10 is being operated to drive the transmission rod 73 to rotate, the drums 711 would be both driven by the transmission rod 73 to rotate synchronously, which would drive the corresponding adjustment cord assemblies 72 to move, whereby to turn the slats 20*a*. The techniques about how the modulation unit 74 drives the slats 20*a* to turn are conventional and well-known, so we are not going to describe related arrangements and operational details herein.

In addition, since the movable member 31 and the driving module 50 in the current embodiment are respectively received in the first groove 11 and the second groove 12, they are separated by an intermediate wall. Therefore, a direction-turning device 80 could be further provided to help to turn the running direction of the transmission cords 60. In the current embodiment, the direction-turning device 80 is immovably provided in the headrail 10, and is embedded at the intermediate wall between the first groove 11 and the second groove 12, communicating the first groove 11 and the second groove 12. Furthermore, the direction-turning device 80 includes at least a wheel 81 provided corresponding to the movable member 31. While arranging the transmission cord 60, it should pass through and get out of the driving module 50, take a turn by passing by the wheel 81, and then get connected to the movable member 31. Whereby, the transmission cord 60 could be prevented from generating fluffs or being broken while passing over the intermediate wall between the first groove 11 and second groove 12; in addition, the smoothness of pulling the transmission cord 60 could be enhanced. Understandably, the wheel 81 of the direction-turning device 80 could be replaced, in other embodiments, by a pin which has a smooth surface and is immovable relative to the headrail 10, which could also provide the effect of turning the running direction of the transmission cord without wearing and tearing. However, the friction created between a pin and the transmission cord would be greater than that created between the rotatable wheel 81 and the transmission cord 60.

The following is the description of how to maneuver the window blind 1 of the present invention. To expand the covering structure 20, the user should grab the bottom rail 20*b* of the covering structure 20 with one hand and move it downward. At this time, the lifting cord assembly 40 would be driven by the bottom rail 20*b*, whereby to pull the movable member 31 to move toward the fixed member 32 along the first groove 11; meanwhile, the transmission cord 60 would be pulled by the movable member 31 and would, therefore, have a corresponding length released from the reel 52. Furthermore, while the reel 52 is releasing the transmission cord 60, the driving wheel 511 would be driven to rotate simultaneously, winding the mainspring 513 around the driving wheel 511 to store energy. To gather the covering structure 20, the user should push the bottom rail 20*b* of the covering structure 20 to make it move upward. At this time, the recovering elastic force of the mainspring 513 would drive the driving wheel 511 to rotate in an opposite direction, which makes the mainspring 513 gradually wind around the storage wheel 512. Meanwhile, the driving wheel 511 would drive the reel 52 to reel in the corresponding length of the transmission cord 60, whereby to drive the movable member 31 to move in the direction away from the fixed member 32 along the first groove 11. In more details, during the process that the covering structure 20 starts to be expanded downward from a state that it is fully gathered relative to the headrail 10, an effective weight of the covering structure 20 applied to the lifting cord assembly 40 gradually reduces. In other words, the pulling force originated from the weight of the covering structure 20 gradually reduces. Therefore, with the cone-shaped reel 52 exemplified in the current embodiment, while the covering structure 20 is being expanded downward, the releasing of the transmission cord 60 starts from the narrower end of the reel 52, and eventually ends at the broader end. If the mainspring 513 is a variable force spring, the reel 52 can be cylindrical, wherein the elasticity outputted by the variable force spring should gradually reduce corresponding to the change of the effective weight of the covering structure 20. Understandably, the forms of the aforesaid reel 52 and the types of the aforesaid mainspring 513 should be able to respond the change amount of the effective weight. On such a premise, a cone-shaped reel and a variable force spring could be both applied in some circumstances, and, of course, other combinations could also be feasible to meet various requirements.

Figure 9:
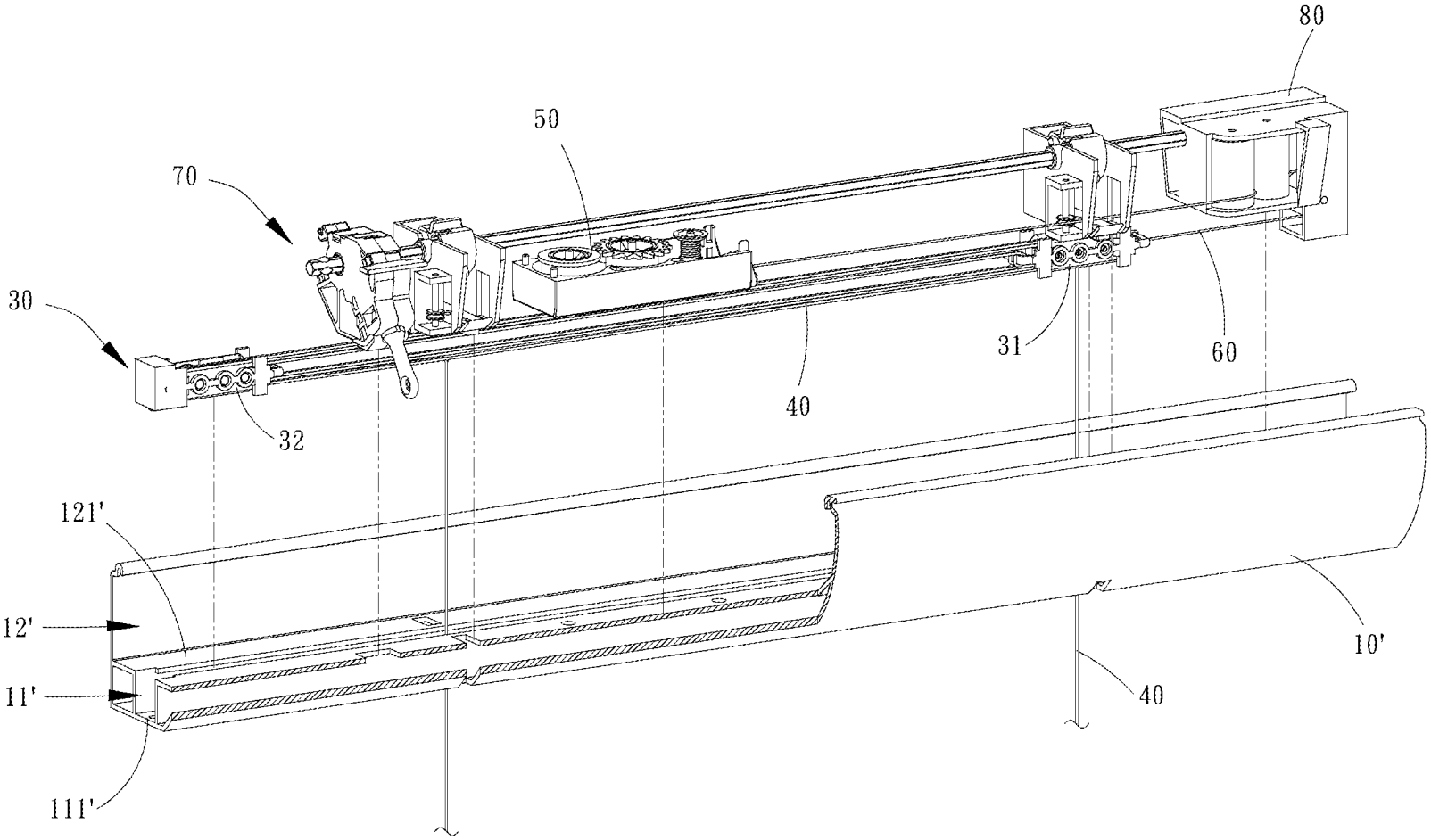
FIG. 9 is a perspective exploded view of the headrail of the window blind of a second embodiment, showing the internal structures and the arrangement of the lifting cord assembly.
Figure 10:
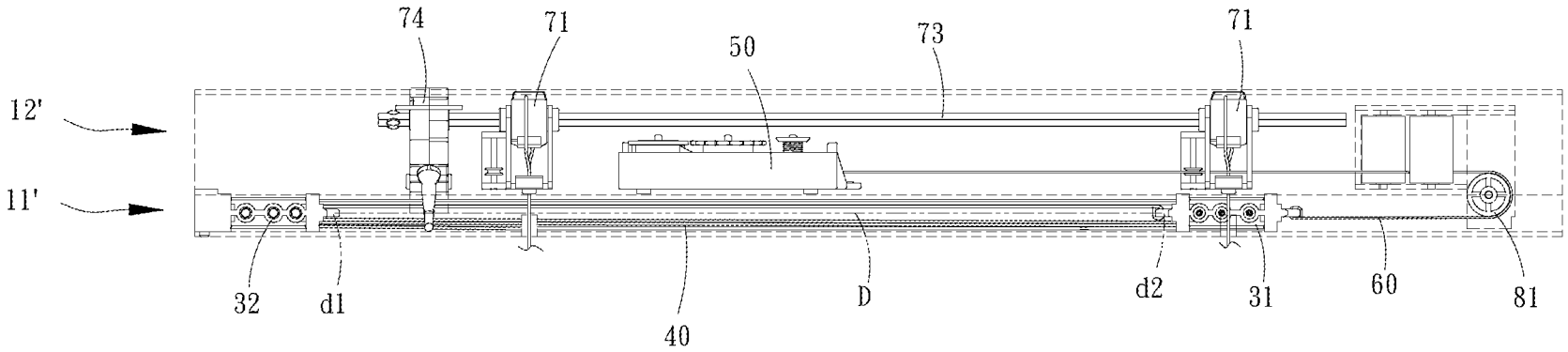
FIG. 10 is a front view of the headrail of FIG. 9, showing the internal structures and the arrangement of the lifting cord assembly.

A headrail system of a second embodiment of the present invention is illustrated in FIG. 9 to FIG. 10, which can be applied to window blinds similar to that shown in FIG. 1. The headrail system of the current embodiment also has the block and tackle system 30, the lifting cord assembly 40, the driving module 50, the transmission cord 60, and the modulation assembly 70, which are substantially the same with those described in the first embodiment. The difference between these two embodiments is in the structures of the headrail 10' of the current embodiment and the headrail 10 of the previous embodiment. In the current embodiment, the headrail 10' has a first groove 11' and a second groove 12', wherein the first groove 11' has a first bottom surface 111', and the second groove 12' has a second bottom surface 121'. The first bottom surface 111' is located below the second bottom surface 121', and the second bottom surface 121' is a support surface formed by a top of a support frame protruded upward from the first bottom surface 111', which means that the first bottom surface 111' and the second bottom surface 121' are not at the same height, so that the first groove 11' and the second groove 12' are arranged in a vertical manner relative to the window blind 1. The block and tackle system 30 is provided in the first groove 11', while the driving module 50 and the modulation assembly 70 are provided in the second groove 12'. Furthermore, the driving module 50 is provided between the two adjustment members 71 of the modulation assembly 70, while the fixed member 32 is not located between the two adjustment members 71. It is worth mentioning that, the second bottom surface 121' is not necessary to be a complete plane as shown in the drawings; in other embodiments, it can be a supportive region formed by tops of multiple support frame arranged in sequence, or can be other structures, as long as the support surface or the supportive region is able to support required components.

In addition, the direction-turning device 80 of the current embodiment is roughly the same as that described in the first embodiment, and is used to turn the running direction of the transmission cord 60. The direction-turning device 80 is provided at the wall between the first groove 11' and the second groove 12', communicating the first groove 11' and the second groove 12'. Furthermore, the window blind 1 of the current embodiment is operated in exactly the same way with that described in the first embodiment, wherein the block and tackle system 30 is also connected to the covering structure 20 and the driving module 50 through the lifting cord assembly 40 and the transmission cord 60, respectively. In addition, when the movable member 31 of the block and tackle system 30 moves in a direction toward the fixed member 32 along the first groove 11', the lifting cord assembly 40 would drive the covering structure 20 to expand. At the same time, the transmission cord 60 would be pulled by the movable member 31, and therefore would be released from the driving module 50. When the movable member 31 moves in another direction away from the fixed member 32 along the first groove 11', the lifting cord assembly 40 would raise and gather the covering structure 20. Meanwhile, the transmission cord 60 would be retracted by the driving module 50.

Figure 11:
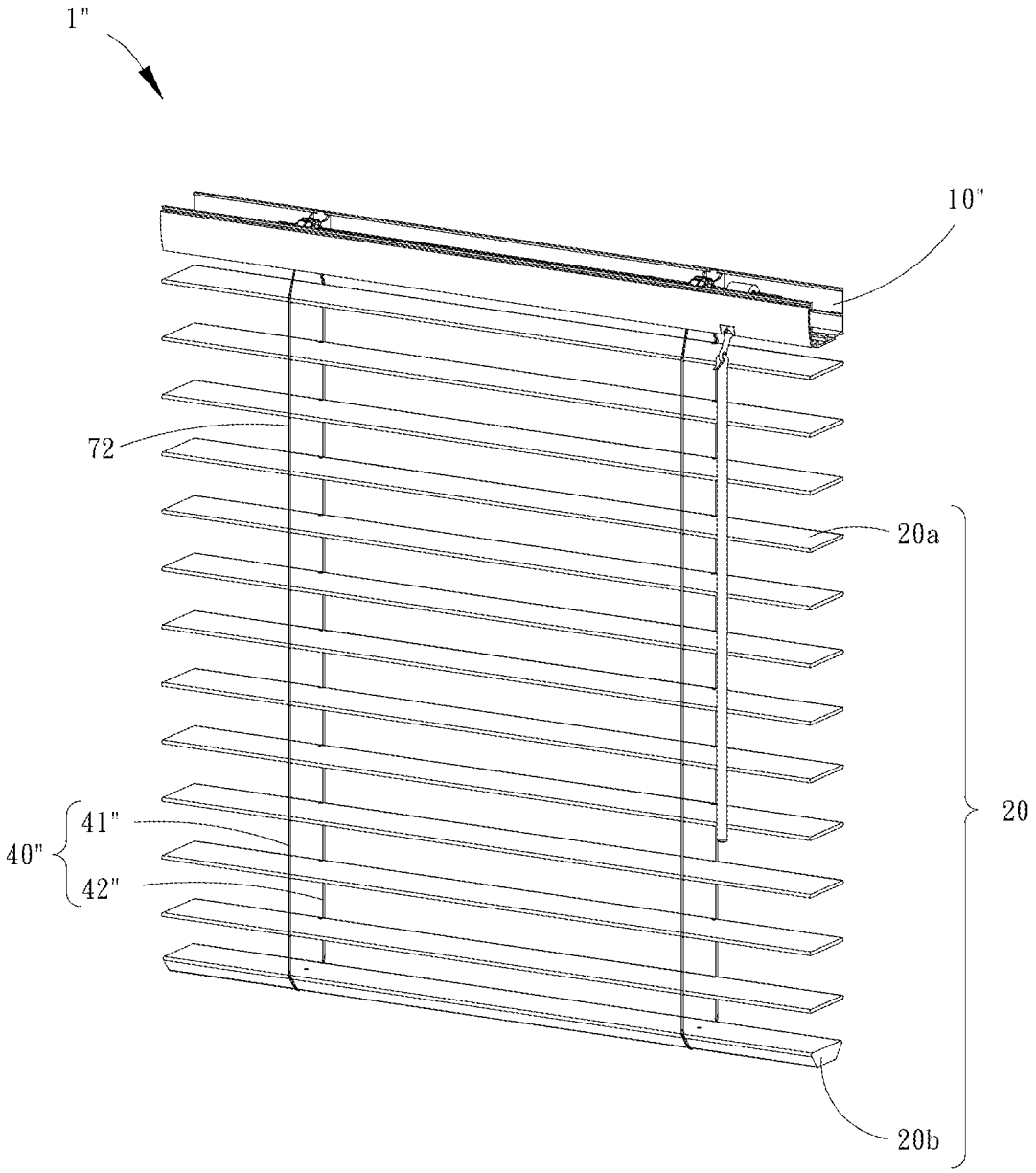
FIG. 11 is a perspective view of the window blind of a third embodiment of the present invention.
Figure 12:
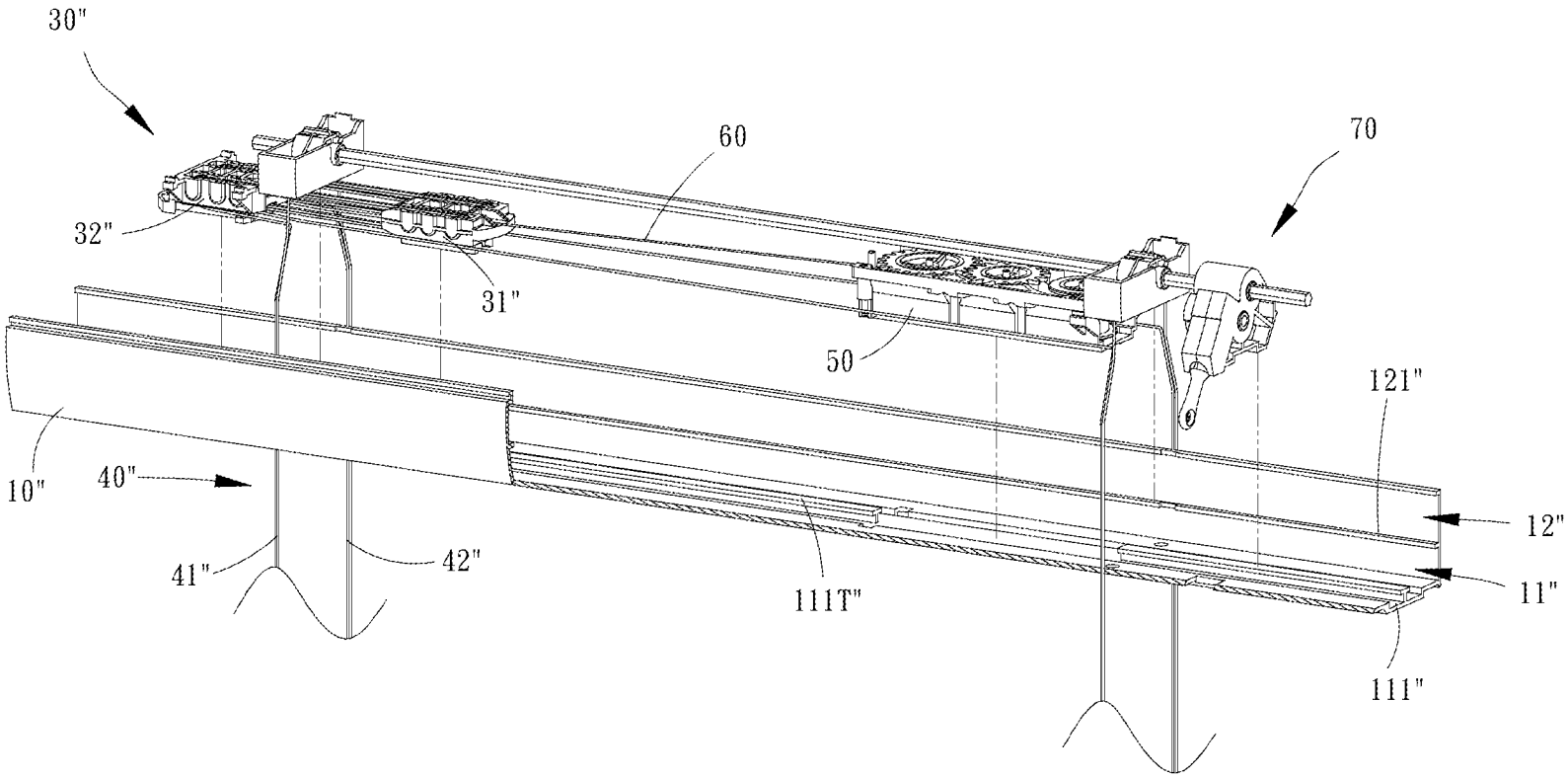
FIG. 12 is a perspective exploded view of the headrail illustrated in FIG. 11, showing the internal structures and the arrangement of the lifting cord assembly.
Figure 17:
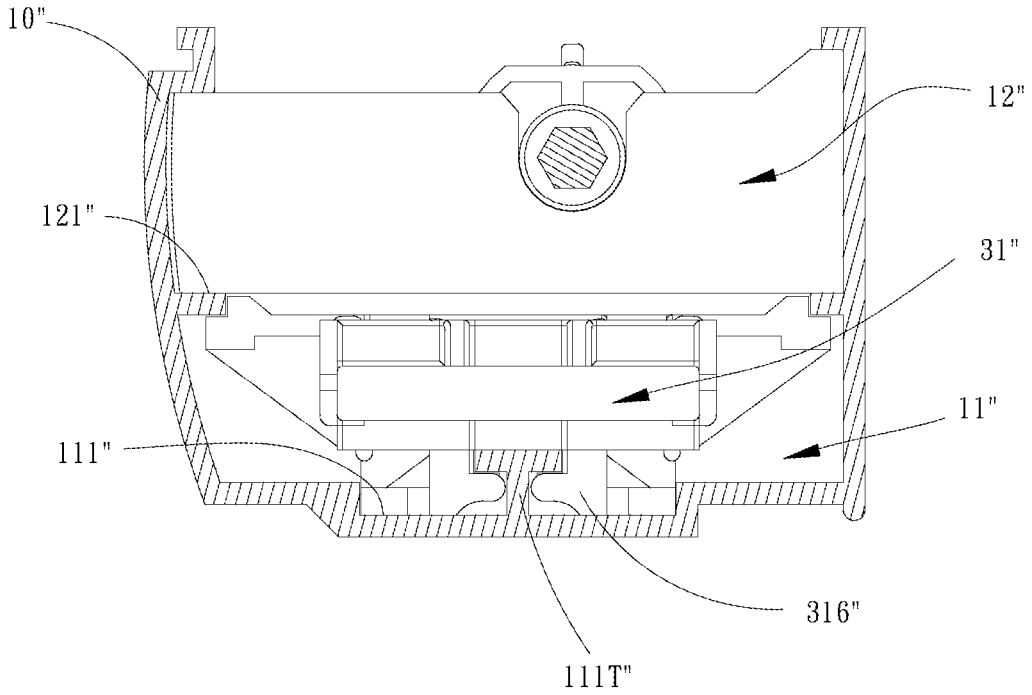
FIG. 17 is a sectional view along the X-X line of FIG. 13, showing the headrail and the internal structures thereof.

A headrail system of a third embodiment of the present invention and a window blind 1" applied with said headrail system are illustrated in FIG. 11 to FIG. 17. The headrail system of the current embodiment also includes the driving module 50, the transmission cord 60, and the modulation assembly 70, which are substantially identical to those described in the first embodiment. The difference is that the structure of the headrail 10" of the current embodiment is different from the structure of the headrail 10 of the first embodiment. In addition, the block and tackle system 30" and the lifting cord assembly 40" provided according to the block and tackle system 30" are not the same with those in the first embodiment, either. In the current embodiment, as shown in FIG. 12 and FIG. 17, the headrail 10" has a first groove 11" and a second groove 12", wherein the first groove 11" has a first bottom surface 111", and the second groove 12" has a second bottom surface 121". The first bottom surface 111" is located below the second bottom surface 121", and has a T-shaped protrusion 111T" protruded upward along a longitudinal direction of the headrail 10". The T-shaped protrusion 111T" includes an upright boardlike long rib which extends along the longitudinal direction of the headrail 10", and another boardlike long rib horizontally disposed on the upright boardlike long rib, forming an elongate structure which, when viewed from side, looks like a letter T. The second bottom surface 121" is a plan protruded from one of surfaces on a front side and a rear side of the headrail 10" which face each other. In other words, the second bottom surface 121" is a plan protruded toward an internal of the headrail 10". Specifically, the second bottom surface 121" extends horizontally, and is located above the first bottom surface 111" by a distance.

The block and tackle system 30" is provided in the first groove 11", and includes a movable member 31" and a fixed member 32". Comparing to the movable member 31 of the first embodiment, the movable member 31" further includes a first cord-winding portion 314" and a second cord-winding portion 315". The first cord-winding portion 314" has a plurality of front rollers 314*a*", 314*b*", 314*c*", and these front rollers 314*a*", 314*b*", 314*c*" are sequentially arranged by their diameters. The second cord-winding portion 315" has a plurality of rear rollers 315*a*", 315*b*", 315*c*", wherein these rear rollers 315*a*", 315*b*", 315*c*" are also sequentially arranged by their diameters. The movable member 31" further has a connecting portion 316" provided at a bottom thereof, wherein the connecting portion 316" has a slot 316S", which is inserted by the upright boardlike long rib of the T-shaped protrusion 111T". With the horizontal boardlike long rib of the T-shaped protrusion 111T" abutting against the slot 316S" of the connecting portion 316", the connecting portion 316" is able to hold the T-shaped protrusion 111T". In this way, the movable member 31" can reciprocate along the T-shaped protrusion 111T" through its connecting portion 316". Comparing to the fixed member 32 of the first embodiment, the fixed member 32" further includes a first cord-winding base 323" and a second cord-winding base 324". The first cord-winding base 323" has a plurality of front rotators 323*a*", 323*b*", 323*c*", wherein these front rotators 323*a*", 323*b*", 323*c*" are sequentially arranged by their diameters. The second cord-winding base 324" has a plurality of rear rotators 324*a*", 324*b*", 324*c*", wherein these rear rotators 324*a*", 324*b*", 324*c*" are sequentially arranged by their diameters. In the current embodiment, the front rollers 314*a*", 314*b*", 314*c*" of the first cord-winding portion 314" and the rear rollers 315*a*", 315*b*", 315*c*" of the second cord-winding portion 315" are respectively arranged in an order that the one with the largest diameter is on the right and the one with the smallest diameter is on the left. Correspondingly, the front rotators 323*a*", 323*b*", 323*c*' of the first cord-winding base 323" and the rear rotators 324*a*", 324*b*", 324*c*" of the second cord-winding base 324" are respectively arranged in an order that the one with the largest diameter is on the left and the one with the smallest diameter is on the right, i.e., arranged in a mirror-symmetry manner with the front rollers 314*a*", 314*b*", 314*c*" of the first cord-winding portion 314" and the rear rollers 315*a*", 315*b*", 315*c*" of the second cord-winding portion 315", respectively.

Figure 14:
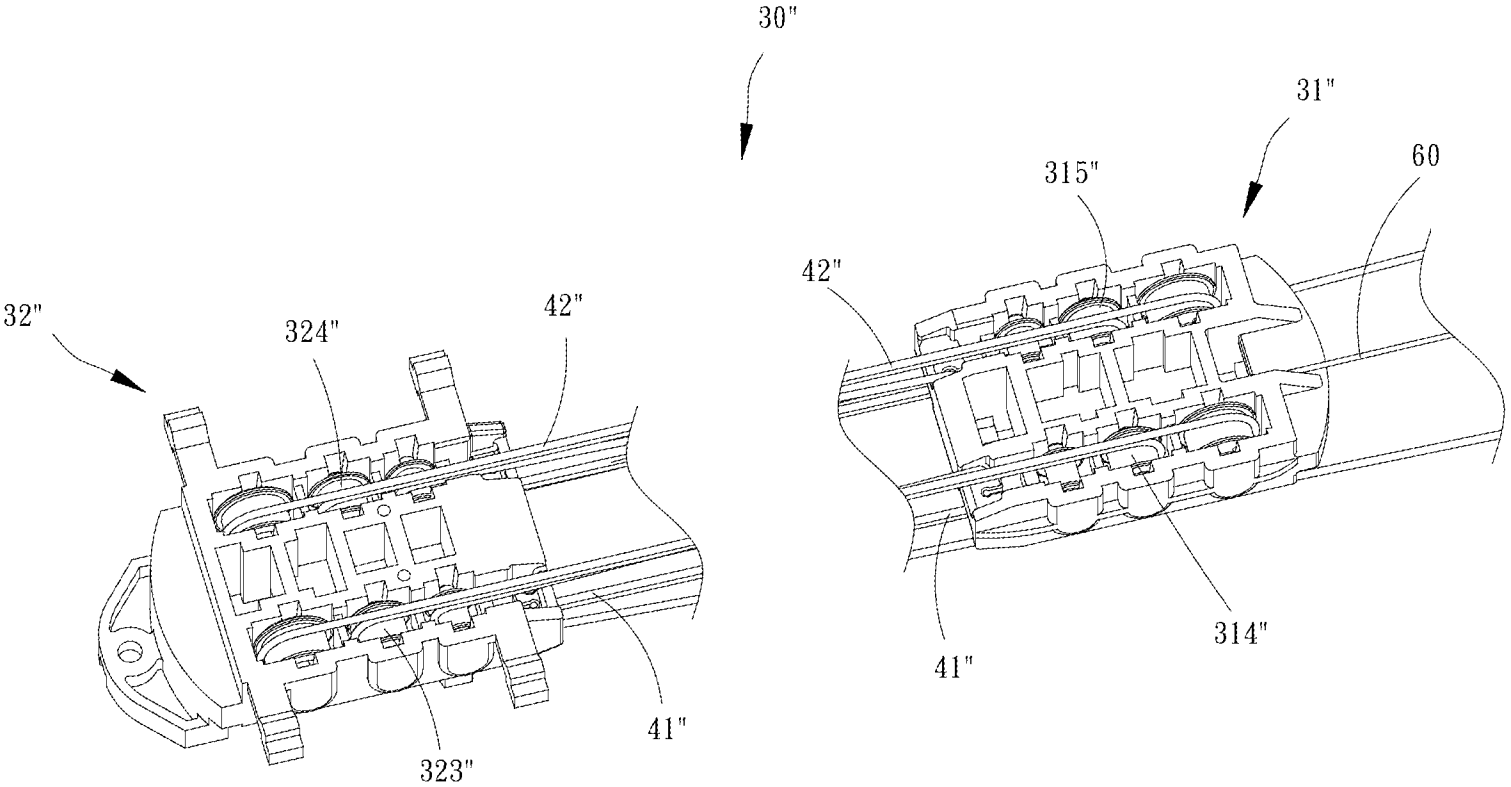
FIG. 14 is a perspective view of the block and tackle system shown in FIG. 12.
Figure 15:
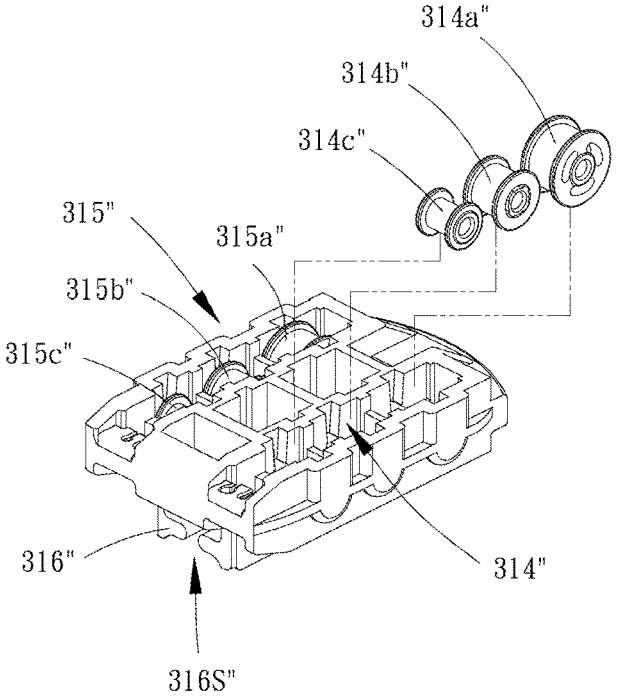
FIG. 15 is a perspective exploded view of the movable member shown in FIG. 14.
Figure 16:
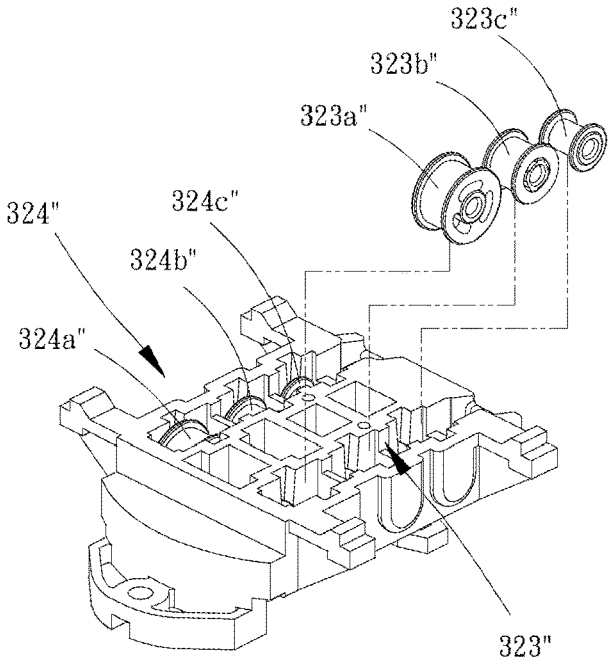
FIG. 16 is a perspective exploded view of the fixed member shown in FIG. 14.

As shown in FIG. 11 and FIG. 14, the lifting cord assembly 40" includes a front cord 41" and a rear cord 42". Two ends of the front cord 41" are respectively connected to the bottom rail 20*b* of the covering structure 20 and the movable member 31". The front cord 41" has a segment passing by a front side of the slats 20*a*, and another segment located in the headrail 10", wherein said segment in the headrail 10" sequentially winds by the front rotators of the first cord-winding base 323" and the front rollers of the first cord-winding portion 314". Since the diameters among the rollers and the diameters among the rotators are respectively different, the front cord 41" which winds thereupon could extend in same directions without interfering with itself. The same as the front cord 41", the rear cord 42" is also connected to the bottom rail 20*b* of the covering structure 20 and the movable member 31" with two ends thereof. And, similarly, the rear cord 42" also has a segment passing by the slats 20*a*, except it goes on the rear side, and has another segment located inside the headrail 10". Said segment of the rear cord 42" in the headrail 10" sequentially winds by the rear rotators of the second cord-winding base 324" and the rear rollers of the second cord-winding portion 315". Again, since the diameters among the rollers and the diameters among the rotators are respectively different, the rear cord 42" which winds thereupon could extend in same directions without interfering with itself. Understandably, though in the current embodiment the front cord 41" winds by the front rotators and the front rollers in sequence, and the rear cord 42" winds by the rear rotators and the rear rollers in sequence, such arrangement is not a limitation of the present invention. In other embodiments, the front cord or the rear cord could only wind by the front rollers and the rear rollers, without winding by the front rotators and the rear rotators. Furthermore, the number of the turns that the front cord or the rear cord makes and the numbers of the rollers and the rotators are all changeable in practice, depending on the full length of the covering structure and the allowed moving path of the movable member. Preferably, the lifting cord assembly 40" could pass through the block and tackle system 30" by making 1.5 to 4 turns, and the distance that the lifting cord assembly 40" moves outside the headrail 10" while raising or lowering the covering structure 20 could be 3 to 8 times a moving distance of the movable member 31" inside the headrail 10".

Figure 13:
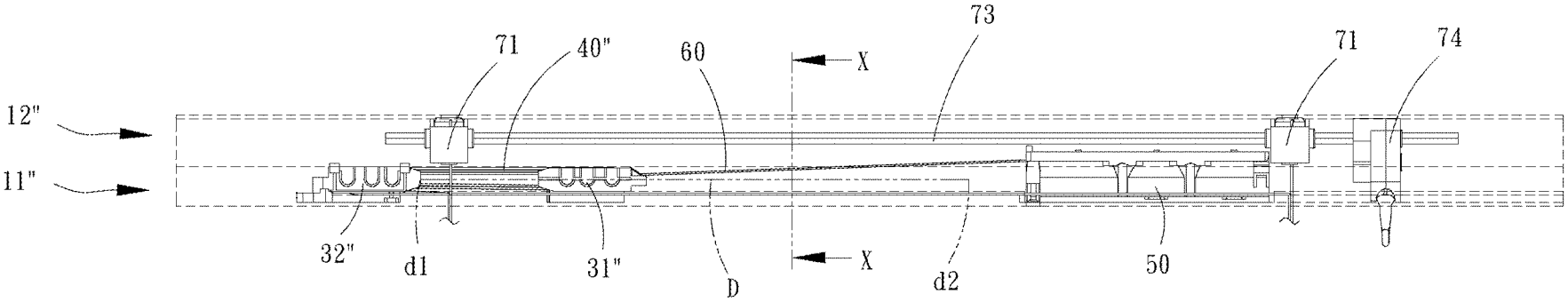
FIG. 13 is a front view of the headrail of FIG. 11, showing the internal structures and the arrangement of the lifting cord assembly.

Furthermore, as shown in FIG. 12 and FIG. 13, the modulation assembly 70 is provided in the second groove 12", and includes two adjustment members 71 which are separated by a distance, wherein the fixed member 32" is not located between the adjustment members 71. The driving module 50 is located in the first groove 11", and is not on the moving path D of the movable member 31". As shown in FIG. 13, the driving module 50 is located between the moving endpoint d2 and an end of the headrail 10" near the moving endpoint d2, without interfering with the moving path D of the movable member 31". The transmission cord 60 connects the movable member 31" and the driving module 50.

The following is the description about how to maneuver the window blind 1" of the current embodiment. The block and tackle system 30" is respectively connected to the covering structure 20 and the driving module 50 through the lifting cord assembly 40" and the transmission cord 60. To expand the window blind 1", the user should grab the bottom rail 20*b* of the covering structure 20 with one hand and move it downward. At this time, the lifting cord assembly 40" would be driven by the bottom rail 20*b*, whereby to pull the movable member 31" to move toward the fixed member 32" along the first groove 11"; meanwhile, the transmission cord 60 would be pulled by the movable member 31" and therefore would be released from the driving module 50. To gather the window blind 1", the user should push the bottom rail 20*b* of the covering structure 20 to make it move upward. At this time, the driving module 50 would retract the transmission cord 60, whereby to move the movable member 31" in a direction away from the fixed member 32" along the first groove 11". As a result, the covering structure 20 can be lifted and gathered as being driven by the lifting cord assembly 40".

It is worth mentioning that, in the present invention, the length of the moving path of the movable member of the block and tackle system reciprocating in the first groove is closely related to the full length of the covering structure. Therefore, in the aforementioned first and second embodiments, the driving module is provided in the second groove and between the adjustment members of the modulation assembly, while the fixed member is disposed at a location where is not between the adjustment members. With such arrangements, the driving module is neither on the moving path of the movable member nor the extension directions of said moving path. Whereby, the operation of the movable member would not be interfered with. In addition, since the fixed member is not located between the adjustment members, the allowed moving distance of the movable member can be extended to its possible lengths. Therefore, it should be easy to understand that, on the premise that the headrail has sufficient internal space, the driving module could be also provided between one of the adjustment members and the end of the headrail near said adjustment member. Or, the driving module could be provided in the first groove, where the movable member is also disposed therein. As long as the driving module can be positioned at a higher position above the moving path of the movable member, the same effect can be also achieved. Or, in yet another embodiment that the allowed moving length of the movable member is long enough to match the full length of the covering structure, the driving module could be also provided in the first groove, which also accommodates the movable member, at a location not between the moving endpoints of the movable member, as described in the third embodiment. The basic requirement in this condition is that the headrail should have sufficient internal space for the movable member of the block and tackle system to fully take the moving path, so as to lift or lower the slat assembly. With such arrangement, the driving module is also not located on the moving path of the movable member, and therefore would not interfere with the operation of the movable member. In summary, with the aforementioned techniques, the arrangement of the components received in the headrail would not be affected by the full length of the covering structure. Furthermore, the cordless window blind provided in the present invention could be smoothly maneuvered, and the bottom rail thereof could be maintained in a horizontal state.

It must be pointed out that the embodiments described above are only some preferred embodiments of the present invention. All equivalent structures which employ the concepts disclosed in this specification and the appended claims should fall within the scope of the present invention.

What is claimed is:

1. A window blind, comprising:

a headrail, a covering structure provided below the headrail, wherein the covering structure comprises a plurality of slats, which are adapted to be turned around a longitudinal direction thereof, and are adapted to be expanded downward or gathered upward relative to the headrail;

a modulation assembly comprising at least two adjustment members and at least two adjustment cord assemblies which are correspondingly provided, wherein the at least two adjustment members are provided in the headrail; each of the at least one two adjustment cord assemblies is connected to the corresponding one of the at least two adjustment members with an end thereof, and has a segment suspended from the headrail to be passed through by the slats; the at least two adjustment members are adapted to be driven to rotate, whereby to drive the corresponding at least two adjustment cord assemblies to operate, turning the slats;

a driving module, which is installed in the headrail and provided between any two of the at least two adjustment members, wherein the driving module comprises a power unit;

a block and tackle system provided in the headrail, wherein the block and tackle system comprises a movable member which is concurrently operable along with the driving module, so that the movable member is adapted to be driven by the power unit of the driving module to optionally reciprocate in a longitudinal direction of the headrail; and a lifting cord assembly, which is connected to the block and tackle system with an end thereof, and extends out of the headrail, wherein another end thereof is fixedly connected to a bottom side of the covering structure; when the movable member reciprocates along the longitudinal direction of the headrail, the lifting cord assembly is driven to expand or gather the slats of the covering structure.

2. The window blind of claim 1, wherein the movable member is adapted to operably reciprocate in the headrail along a moving path, and the modulation assembly is not on the moving path or an extension direction thereof.

3. The window blind of claim 1, wherein the movable member is adapted to operably reciprocate in the headrail along a moving path, and the driving module is not on the moving path or an extension direction thereof.

4. The window blind of claim 1, wherein the headrail comprises a first groove and a second groove; the first groove and the second groove are adjacent to each other, and both extend in the longitudinal direction of the headrail; the movable member is provided in the first groove, and is adapted to reciprocate along the first groove on a moving path; at least one of the modulation assembly and the driving module is provided in the second groove.

5. The window blind of claim 4, wherein the first groove has a first bottom surface, and the second groove has a second bottom surface; the first bottom surface and the second bottom surface are at different heights.

6. The window blind of claim 4, wherein the first groove has a first bottom surface, and the second groove has a second bottom surface; the first bottom surface and the second bottom surface are at a same height.

7. The window blind of claim 1, wherein a distance that the lifting cord assembly moves outside the headrail while expanding or gathering the covering structure is 3 to 8 times a moving distance that the movable member moves in the headrail.

8. The window blind of claim 1, wherein the lifting cord assembly comprises a front cord and a rear cord; the front cord passes by a front side of the covering structure, while the rear cord passes by a rear side of the covering structure; the movable member comprises a first cord-winding portion and a second cord-winding portion, wherein the front cord winds by the first cord-winding portion, while the rear cord winds by the second cord-winding portion.

9. The window blind of claim 8, wherein the first cord-winding portion comprises at least two front rollers which have different diameters; the front cord winds by the at least two front rollers without interfering with itself.

10. The window blind of claim 9, wherein the second cord-winding portion comprises at least two rear rollers which have different diameters; the rear cord winds by the at least two rear rollers without interfering with itself.

11. The window blind of claim 1, wherein the block and tackle system comprises a fixed member corresponding to the movable member; the fixed member is immovable relative to the headrail; the lifting cord assembly is fixedly connected to one of the fixed member and the movable member with an end thereof, and passes by the other one or both of the fixed member and the movable member.

12. The window blind of claim 11, wherein the lifting cord assembly passes through the block and tackle system with 1.5 to 4 turns.

13. The window blind of claim 1, wherein the window blind further comprises a transmission cord, and the driving module further comprises a reel which is concurrently operable along with the power unit; the transmission cord passes through the driving module with an end thereof connected to the reel and another end thereof connected to the movable member; when the covering structure is maneuvered to be lowered, the movable member moves as being pulled by the lifting cord assembly, and the transmission cord is released from the reel; when the covering structure is maneuvered to be lifted, the reel is driven by the power unit to retract the transmission cord, whereby to drive the movable member to move in an opposite direction.

14. The window blind of claim 13, wherein the window blind further comprises a direction-turning device, which is immovably provided in the headrail, corresponding to the movable member; the transmission cord is connected to the movable member after passing through the driving module and passing by the direction-turning device.

15. The window blind of claim 13, wherein the power unit of the driving module comprises a mainspring, a driving wheel, and a storage wheel; the mainspring connects the driving wheel and the storage wheel, and the reel and the driving wheel are provided in a way that the reel and the driving wheel are concurrently operable along with each other, whereby the reel is drivable by the driving wheel.

16. The window blind of claim 15, wherein the reel has a first gear disk, and the driving wheel has a second gear disk; the first gear disk meshes with the second gear disk, so that the reel and the driving wheel are adapted to be operated synchronously.

17. The window blind of claim 16, wherein the reel is cone-shaped, and a body of the reel has an end of a small diameter and another end of a large diameter; when the covering structure starts to be lowered from a fully-gathered state, the transmission cord is released from the end of the reel with the small diameter.

18. The window blind of claim 16, wherein the mainspring is a variable force spring; while the covering structure is being lowered from a fully-gathered state, an elasticity provided by the variable force spring gradually decreases.

* * * * *